US008950440B2

(12) United States Patent
Deschamps

(10) Patent No.: US 8,950,440 B2
(45) Date of Patent: Feb. 10, 2015

(54) WEAVING METHOD AND LOOM FOR IMPLEMENTING THIS METHOD

(71) Applicant: Ets A. Deschamps et Fils, La Couronne (FR)

(72) Inventor: Georges-Paul Deschamps, Voeuil et Giget (FR)

(73) Assignee: Ets A. Deschamps et Fils, La Couronne (FR)

( * ) Notice: Subject to any disclaimer, the term of this patent is extended or adjusted under 35 U.S.C. 154(b) by 0 days.

(21) Appl. No.: 14/030,489

(22) Filed: Sep. 18, 2013

(65) Prior Publication Data

US 2014/0014222 A1 Jan. 16, 2014

Related U.S. Application Data

(62) Division of application No. 12/864,991, filed as application No. PCT/EP2009/050955 on Jan. 28, 2009, now Pat. No. 8,627,855.

(30) Foreign Application Priority Data

Jan. 29, 2008 (FR) ..... 08 50542

(51) Int. Cl.

| | |
|---|---|
| ***D03C 9/06*** | (2006.01) |
| ***D03C 13/00*** | (2006.01) |
| ***D03D 11/00*** | (2006.01) |
| ***D03D 25/00*** | (2006.01) |
| ***D03J 1/22*** | (2006.01) |
| *D03D 41/00* | (2006.01) |

(52) U.S. Cl.

CPC ..... *D03D 41/00* (2013.01); *D03D 11/00* (2013.01); *D03D 25/005* (2013.01); *D03D 41/004* (2013.01); *D03J 1/22* (2013.01)

USPC ..... 139/55.1; 139/11

(58) Field of Classification Search

None

See application file for complete search history.

(56) References Cited

U.S. PATENT DOCUMENTS

| | | | | |
|---|---|---|---|---|
| 2,848,018 | A | | 8/1958 | Neisler |
| 3,048,198 | A | | 8/1962 | Koppelman et al. |
| 3,769,142 | A | * | 10/1973 | Holmes et al. ..... 428/113 |
| 4,067,208 | A | * | 1/1978 | Heimberger ..... 66/193 |
| 4,379,798 | A | * | 4/1983 | Palmer et al. ..... 428/113 |

(Continued)

FOREIGN PATENT DOCUMENTS

EP 1 347 087 9/2003

OTHER PUBLICATIONS

International Search Report, dated Apr. 29, 2009, from corresponding PCT application.

*Primary Examiner* — Bobby Muromoto, Jr.

(74) *Attorney, Agent, or Firm* — Young & Thompson

(57) ABSTRACT

The loom includes a weaving area (18) into which weft threads are inserted into at least one upper channel and one lower channel, each of these weft threads being inserted between at least two warp threads by at least one weft insertion element: first element for focusing on one of these channels and determining the position of the warp threads relative to the weft thread, and second element for inserting at least one binding thread (16) above, between and below these channels. The loom includes at least one element for gripping the at least one binding thread and element for moving the at least one gripping element out of and into the weaving area (18) so as to place the at least one gripping element in contact with the at least one binding thread and to allow the drawing of the at least one binding thread.

11 Claims, 4 Drawing Sheets

(56) References Cited

U.S. PATENT DOCUMENTS

| | | | | | |
|---|---|---|---|---|---|
| 4,734,146 | A * | 3/1988 | Halcomb et al. | 156/148 |
| 4,821,780 | A * | 4/1989 | Tate | 139/383 A |
| 5,021,281 | A * | 6/1991 | Bompard et al. | 428/116 |
| 5,026,595 | A * | 6/1991 | Crawford et al. | 428/193 |
| 5,783,279 | A * | 7/1998 | Edgson et al. | 428/116 |
| 6,696,122 | B1 * | 2/2004 | Deschamps | 428/36.1 |
| 2005/0224130 | A1 * | 10/2005 | Takimoto et al. | 139/408 |
| 2006/0278295 | A1 * | 12/2006 | Ueda et al. | 139/383 A |
| 2009/0176427 | A1 * | 7/2009 | Hansen et al. | 442/184 |
| 2010/0285265 | A1 * | 11/2010 | Shinoda et al. | 428/80 |
| 2011/0036446 | A1 * | 2/2011 | Deschamps | 139/11 |
| 2012/0153780 | A1 * | 6/2012 | Whinnery et al. | 310/366 |

* cited by examiner

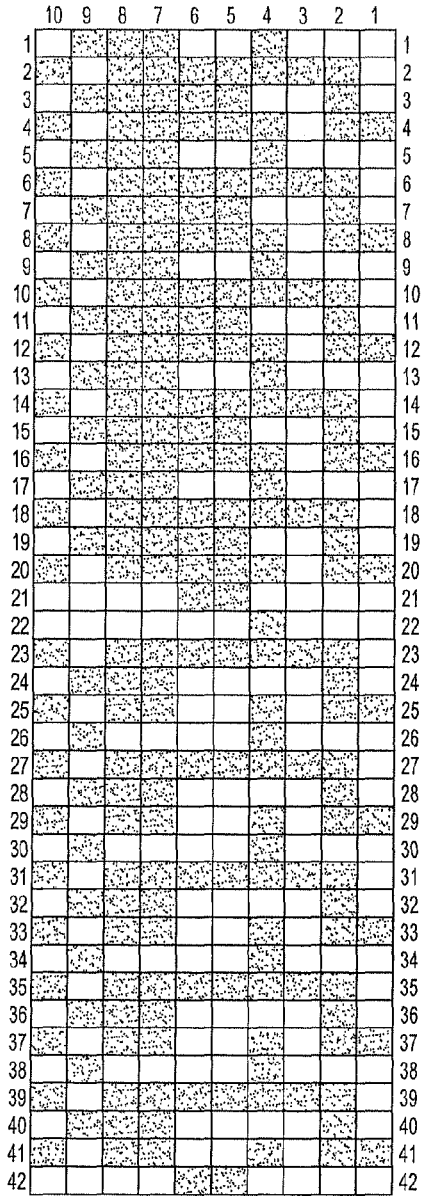
Fig. 5
Fig. 8
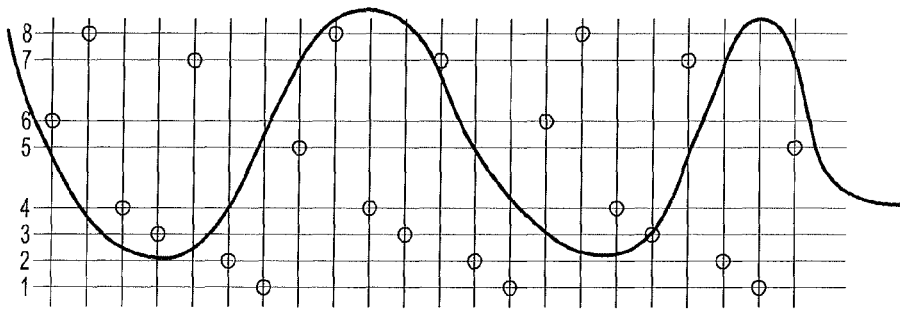

WEAVING METHOD AND LOOM FOR IMPLEMENTING THIS METHOD

The invention relates to a weaving method and a loom for implementing this method. It relates more especially to a method for weaving a flexible container.

Inflatable cushions for lifting aircraft are known that have been designed to facilitate the towing from the mud and the recovery of commercial and military aircraft that accidentally veered off the runway.

These cushions allow airport emergency crews confronted with an aircraft off the runway to lift the latter and then to tow it quickly and safely while avoiding causing any secondary damage to it.

FIG. 1 is a cutaway view of a lifting cushion for an aircraft of the prior art. This cushion typically comprises two woven walls 1, 2 that have been coated for sealing and hot-vulcanized. These woven walls 1, 2 are connected on their periphery by excess rubber thickness 3.

These walls 1, 2 are also connected to one another by polyamide threads 4, which, when they are put under tension by inflation of the cushion, are parallel and evenly spaced from one another.

These threads 4 are of identical length so as to keep the walls 1, 2 parallel. The application of a uniform lifting pressure on the aircraft structure under which the cushion is placed is thus ensured.

This latter point is especially critical, for example, during the lifting of fragile elements such as an aircraft wing 5 to prevent the onset of structural damage (FIG. 2).

Now, losses of air from these lifting cushions can be observed that result from a manufacturing defect or that appear over time at rupture points 6 of the structure of the lifting cushion. By way of illustration, manufacturing defects can result from poor vulcanization or else from slipping of the excess rubber thickness 3 before vulcanization.

Such defects lead to a non-uniform application of the lifting force on the structure of the aircraft and may be responsible for secondary damage.

There is thus a critical need for an inflating cushion that is produced in a single piece in order to offer increased resistance to stress.

More generally, numerous woven articles that exhibit a complex shape, such as polystyrene pellet-filled cushions, chair slipcovers, etc., . . . , result from the assembly of initially separate textile pieces that are then joined, for example by stitching, to impart its definitive shape to the article.

Now, these articles by definition exhibit a certain structural weakness at these assembly areas.

Premature wear of the article at these areas can result in, for example, the loss of the filling material of the article.

Finally, the assembly times for these articles that have a complex shape can be relatively long and require skilled operators, making the article expensive.

The object of this invention is thus to suggest a weaving method and a weaving machine for implementing this method, simple in their concept and their operating mode for producing a one-piece woven article, thus imparting to it mechanical properties that are superior to known articles of the prior art obtained by assembly of initially separate elements by sewing, gluing, . . . , or by a combination of these assembly modes.

Another object of the invention is a method for weaving a one-piece woven structure with a complex shape such as a conical or cylindrical shape for implementing composite pieces such as radomes, sections of aircraft fuselage, ship hulls, or indoor or outdoor furniture.

To do this, the invention relates to a method for weaving at least two layers linked to one another by at least one binding thread.

According to the invention a) weaving of these layers is initiated by inserting at least one warp thread or supplementary filling pick, the latter comprising said binding thread, into the basic weave of a first layer, b) before the insertion of said at least one binding thread into the basic weave of the second layer, weaving of the layers is suspended, c) said at least one binding thread is drawn from the side of the second layer by placing at least a portion of the length drawn to the outside of the unit formed by these thus connected layers, d) then, weaving of said layers is resumed by inserting said at least one binding thread into the basic weave of the second layer, before each new insertion of said at least one binding thread into the basic weave of one of these layers, the following cycle is repeated:

e) weaving of said layers is suspended, f) said at least one binding thread is drawn by placing at least one portion of the length drawn to the outside of the unit formed by these thus connected layers, g) then, weaving of the layers is resumed by inserting said at least one binding thread into the basic weave of said layer.

The method of the invention makes it possible to produce woven structures comprising at least two woven walls connected to one another by at least one unjoined binding thread.

This woven structure can be closed or at least partially open. This opening can be placed anywhere in the woven structure, i.e., at at least one of its ends, the corresponding edges of these walls then not being linked to one another, or it can result from the presence of an opening on at least one of the walls.

The cross-section of this woven structure can advantageously have any shape such as a circle, square, rectangle, diamond, T, U, L, H, or I . . . after optional cutting of the unnecessary warp threads.

"Unjoined binding thread" is defined as this thread not being joined after weaving of each of these walls for their assembly, but quite to the contrary, being inserted into the weft of these woven walls as they are being produced. The binding thread is thus an integral part of the weave of the two walls on portions of the latter.

The woven structure obtained in this way is a single piece that imparts to it increased mechanical resistance to stresses.

This woven structure can be either a single piece or conversely can comprise different materials.

The expression "the woven structure is a single piece" means that this structure is made in one piece and is produced from a single material. The warp or weft threads that are used can be of different shape, however, i.e., a monofilament thread, a multifilament thread, a flat thread, a thread formed by twisted fibers, a single or rotor thread, for example, and can have different thicknesses or diameters.

These threads can be, for example, cotton threads, polyester threads; threads of polyamide, polypropylene, polyethylene; threads of biodegradable plastic material based on starch, oxo-degradable plastic materials; or threads formed from fibers of carbon, graphite, glass, silicon, aramid, . . . .

The walls can, moreover, have different dimensions and/or different shapes depending on the intended application for the woven structure.

The binding threads can advantageously be produced in different materials in terms of the weft of the woven structure so that this structure has different mechanical resistance areas.

In different particular embodiments of this weaving method, each having its particular advantages that are subject to numerous possible technical combinations:

after weaving of these layers, they are separated from one another to return said at least one portion of the drawn length between these layers and to impart its final shape to the unit formed by the thus linked layers, at stages c) and f), the binding threads are drawn so that these binding threads, being put under tension, at least most of the lengths between two of these threads left consecutive, are rectilinear, being spaced evenly or not, at stages c) and f), at least one gripping element is inserted into this weaving area to draw solely said at least one binding thread, and before the corresponding stages d) and g), this gripping element is removed from the weaving area, this gripping element being a temple, it has a different shape between at least two successive cycles e), f) and g) to impart a complex shape to the unit formed by the thus linked layers.

A "temple" is a rod that can be passed under the binding threads so as to ensure their drawing.

At least the edge of the temple designed to receive said at least one binding thread can exhibit a shape that is used to imprint the relief to be imparted to one of these layers to the right of said at least one binding thread. This shape is especially advantageous when it is necessary to draw the binding threads of a different length in the direction of the warp or weft to impart a complex shape on one of the layers relative to another. Of course, it may be necessary to change the temple between the consecutive cycles of weaving and drawing the binding threads to construct the definitive shape of this layer during the weaving of the unit formed by said at least two layers that are thus linked to one another by at least one binding thread.

Each binding thread is drawn with a needle comprising on its end a hook to receive said binding thread and by moving this needle in translation, the lengths drawn on at least one portion of this unit formed by the thus linked layers in the direction of the warp and/or the weft are varied in a manner that may or may not be continuous.

"Continuous variation" means that this variation is uniform and does not have any sudden jumps or plateaus. Conversely, this variation can have plateaus.

The drawn lengths are constant over at least a portion of this unit formed by the layers that are thus linked in the direction of the weft and/or warp, the following stages are carried out:

a) simultaneous weaving of an upper wall, an intermediate wall and a lower wall is initiated by inserting into the basic weaves of one of the upper and intermediate layers and of one of the lower and intermediate layers at least one warp thread or supplementary filling pick, the latter comprising the binding thread of the upper and intermediate layers and of the lower and intermediate layers, b) before insertion of at least one binding thread into the other layer of upper and intermediate layers and of lower and intermediate layers respectively, weaving of these layers is interrupted, c) said at least one binding thread of the upper and intermediate layers and of the lower and intermediate layers of a given length is drawn by placing at least a portion of these lengths drawn to the outside of the unit formed by the thus linked walls, d) weaving of the layers is resumed by inserting said at least one binding thread of the upper and intermediate layers and of the lower and intermediate layers into the basic weave of this other layer, before each new insertion of said at least one binding thread into the basic weave of said upper and intermediate layers and of said lower and intermediate layers, respectively, e) weaving of these layers is suspended, f) at least one binding thread of the upper and intermediate layers and of the lower and intermediate layers of a given length is drawn by placing at least a portion of these lengths drawn to the outside of the unit formed by the thus linked walls, g) then, weaving of said layers is resumed by inserting said at least one binding thread of the upper and intermediate layers and of the lower and intermediate layers into the basic weave of said other layer.

Preferably, said at least one binding thread of the upper and intermediate walls is drawn with a first gripping element by placing at least a portion of the length drawn above the upper layer, and said at least one binding thread of the lower and intermediate walls is drawn with a second gripping element by placing at least a portion of the length drawn under the lower layer.

Advantageously, said at least one binding thread and the constituent threads of these layers are pre-impregnated in advance at the start of the weaving operations.

For example, these threads can be pre-impregnated with a thermosetting or thermoplastic resin and especially a thermostable thermoplastic resin such as one from the families of polyether imides (PEI), polyether ether ketones (PEEK), or polyamides (PA).

The invention also relates to a loom comprising a weaving area in which weft threads are inserted into at least one upper channel and one lower channel, each of these weft threads being inserted between at least two warp threads by at least one weft insertion element: first means for managing one of these channels and for determining the position of the warp threads relative to the weft thread, and second means for inserting at least one binding thread above, between and under these channels.

According to the invention, this loom comprises at least one element for gripping said at least one binding thread and means of moving said at least one gripping element outside of and into the weaving area for placing said at least one gripping element in contact with said at least one binding thread and allowing the drawing of at least one binding thread.

Said at least one gripping element can be a temple. Advantageously, the edge of this temple designed to receive said at least one binding thread comprises means for holding these binding threads to prevent their slipping as they are being drawn.

Preferably, at least the edge of the temple designed to receive said at least one binding thread has a shape for impressing the relief to be imparted to one of these layers to the right of said at least one binding thread.

Said at least one gripping element can also be a needle comprising on its end a hook for receiving a binding thread. The loom therefore comprises both a needle and the binding thread to be drawn. The means of movement of each needle comprises, for example, an electromagnet or a hydraulic or pneumatic piston. The movement of these needles is controlled by control means.

Advantageously, these control means are individual means for control of each needle so as to allow variation of the drawn length of one binding thread to another. Each needle can then move in translation.

Preferably, this loom is a dry loom such as an air jet loom, a spear loom, or a projectile loom.

The invention also relates to at least one woven structure obtained by the process or loom such as described above for producing composite pieces in which said at least one woven structure is placed in a mold, said mold is closed, a matrix material is inserted into said mold, and then the thus obtained unit is hardened.

The invention also relates to a composite piece comprising a preform obtained by the method or by means of the loom as described above, this preform being embedded in a matrix material.

These composite pieces are, for example, structural panels, for example, for vehicles such as aircraft or automobiles. It can also relate to furniture.

The matrix material that is used is, for example, a thermosetting or thermoplastic resin and especially a thermostable thermoplastic resin such as one from the families of polyether imides (PEI), polyether ether ketones (PEEK), or polyamides (PA).

The polymerization operations are known processes of the prior art that will not be described again here. Purely by way of illustration, simply the resin transfer molding (RTM) method or else the liquid resin infusion (LRI) molding method will be mentioned.

BRIEF DESCRIPTION OF DRAWINGS

FIG. 5 shows the weave of the flexible reservoir from FIG. 3;

FIG. 8 shows the empassage followed by the flexible reservoir.

FIG. 3 is a top view of a flexible reservoir according to one preferred embodiment of the invention. This flexible reservoir is composed of a woven structure comprising two woven walls 10, 11 that are connected to one another by unjoined binding threads. These walls have been circularly woven; this imparts increased mechanical strength to the container since the threads on each end of the woven structure have not been cut.

Figure 1:
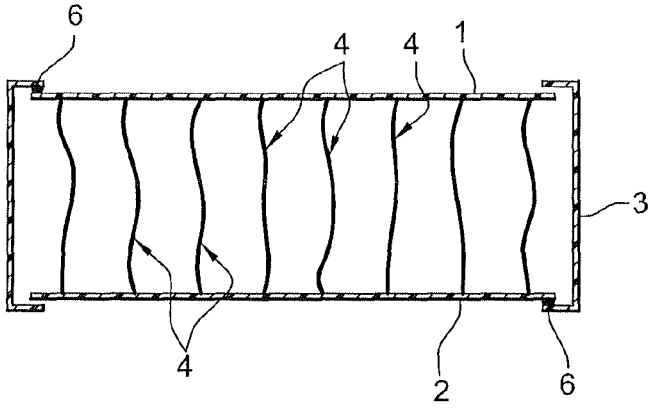
FIG. 1 is a cutaway view of a lifting cushion of the prior art.
Figure 2:
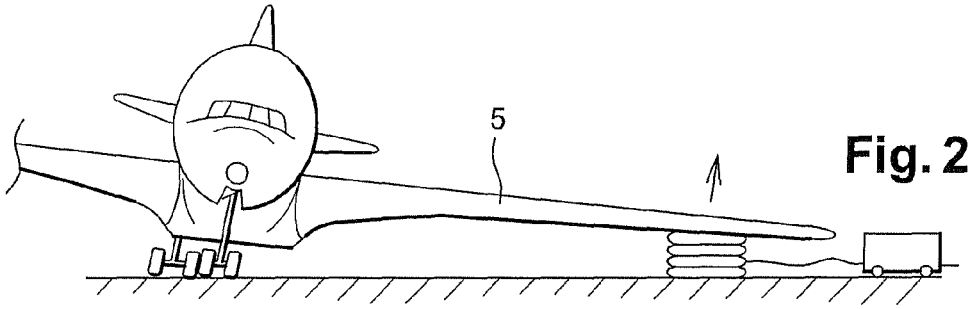
FIG. 2 shows a pile of lifting cushions from FIG. 1 placed under the wing of an aircraft that has left the runway for purposes of lifting it.
Figure 3:
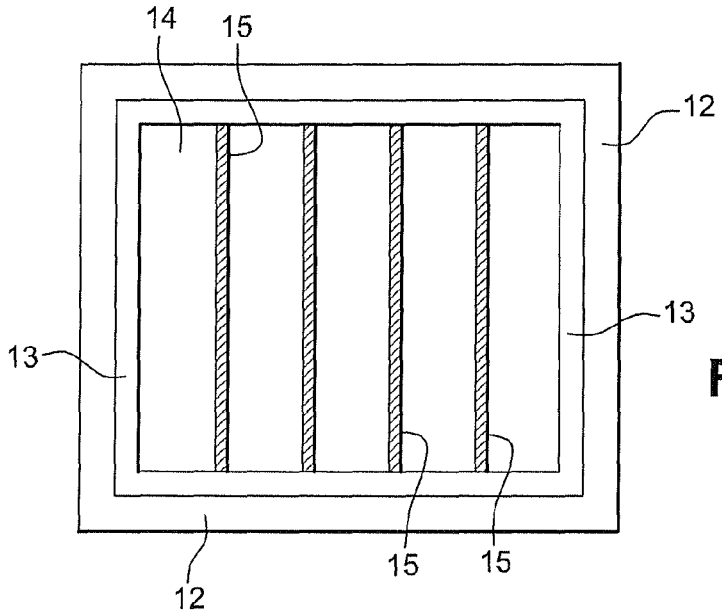
FIG. 3 shows a top view of a flexible lifting reservoir according to one preferred embodiment of the invention.

These two walls 10, 11 are continuous and have several parts extending from one edge of the reservoir toward its center.

Over the entire periphery of the reservoir, there is first of all a first flat-woven part 12. This first part 12 forms the edge of the reservoir. This edge corresponds to the assembly of two woven walls and delineates the edge of the reservoir. This edge 12 makes it possible to accommodate accessories such as eyelets, . . . , and to stretch the flexible container. Purely by way of illustration, the width of this first part is roughly 15 cm.

There is then a so-called rounded second part 13 that makes it possible to impart a rounded shape to the contour of the flexible container after filling the latter with a gaseous fluid such as air, or with particles such as sand, polystyrene pellets, . . . .

When this container is tight, this second part 13 makes it possible to set the dimensions of the level of inflation of the flexible reservoir. The container is made tight after weaving of the woven structure, yielding the shape of the reservoir by a stage of coating of this structure with a sealing material such as a polyvinyl chloride (PVC)- or polyurethane-based material or even better a fire-resistant plasticized PVC-based material.

It is from this level that the layers 11, 12 are separated as they are being connected to one another by the binding threads inserted alternatively into the basic weaves of the upper and lower layers. These two walls 11, 12 have a 1 by 1 cloth weave with a number of warp threads greater than 10 threads/cm and a number of weft threads greater than 6 threads/cm so as to ensure good tightening of the woven structure. Of course, these weaves need not be identical. There could thus be a honeycomb weave for the base of the upper wall such that the latter has female indentations intended to accommodate the male indentations placed on the lower layer (honeycomb weave) of another reservoir superimposed on this flexible reservoir.

This area in which the layers 10, 11 are connected to one another by the unjoined binding threads comprises the central part 14 of the flexible reservoir. In the latter, handles 15 are placed that allow the two layers 10, 11 to be moved apart in order to allow the lengths drawn from the binding threads to be fitted into the unit formed by these two layers that are linked to one another.

Purely by way of illustration, the warp threads of this woven structure are multifilament polyester threads with 2354 dtex for the envelope, i.e., the edge 12 and second part 13 and the central part 14 and the handles 15. For the binding threads 16 that are the supplementary warp threads here, multifilament polyester threads with 2×235 dtex with 215 S turns are used. The density of the binding threads is typically between one thread/10 $cm^2$ and several hundred threads/$cm^2$. Finally, the weft threads are multifilament polyester threads with 2354 dtex.

More generally, the binding threads are chosen from the group comprising monofilament threads, multifilament threads, single or rotor threads, threads comprising agglomerated fibers, flat threads, flexible metallic threads, sheathed threads, i.e., each comprising a core thread and a sheath made of thermoplastic material, and combinations of these elements.

A "flat thread" is defined as a product extruded through a die, drawn or otherwise, of which the full cross-section that is essentially constant over its entire length is in the shape of an oval, square, rectangle, flattened circle or modified square or rectangle, i.e., having two opposite sides with the shape of a convex arc, the other two being rectilinear, equal and parallel. These flat threads could also be hollow and have a flattened tubular section, by way of illustration.

The warp, weft and binding threads can be, for example, cotton threads, polyester threads; threads of polyamide, polypropylene, polyethylene; threads of biodegradable plastic materials based on starch, oxo-degradable plastic materials; and threads formed from fibers of carbon, graphite, glass, silicon, aramid, . . . .

Figure 4:
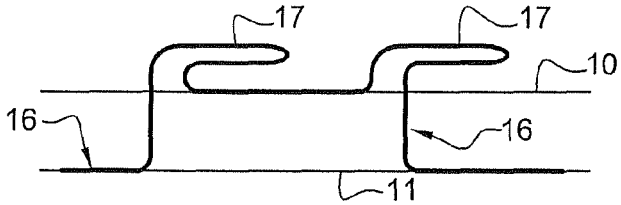
FIG. 4 is a partial schematic showing the drawn lengths of the binding threads placed outside of the unit formed by the layers linked to one another by the binding threads.

The woven structure yielding the shape of the reservoir has been obtained according to the production method described below (FIG. 4).

Weaving of the walls begins simultaneously with weaving an upper layer 10 and a lower layer 11 following the basic weave of each of these walls, the binding threads 16 being connected solely to the basic weave of the upper layer 10. At the instant of joining these two walls 10, 11 by the binding threads, i.e., before binding the binding threads in the lower layer 11, weaving is interrupted and a rod called a temple is inserted into the weaving area to draw solely these binding threads 16. Since the rod has a constant cross-section, the length of the thus drawn binding threads is identical. This drawn length is placed above the upper layer 10 by forming a loop 17.

This length, thus drawn, of the binding threads, as well as the distance separating the upper layer 10 and the lower layer 11, corresponds to the distance separating the walls of the final reservoir, i.e., its operating thickness.

Once the binding threads have been drawn to a satisfactory length, the temple is removed from the weaving area, and production of the woven walls 10, 11 resumes normally until the next joining of the walls by these binding threads 16.

These binding threads 16 are therefore drawn on the top of the two layers forming the upper and lower walls of the woven structure, and the lengths thus drawn are thus placed in part outside of the woven structure by forming loops 17. Alternatively, the temple can be moved under the unit formed by these layers that have been linked to one another such that the loops 17 are placed in part under this unit.

These binding threads 16 are then returned to the woven structure as the layers are moved apart from one another using the handles 15.

Finally, the woven structure is coated with a sealing material for forming the lifting reservoir.

FIG. 5 shows the weave of this woven structure with a reservoir shape for producing and binding the upper wall 10 and the lower wall 11. This conventionally shown weave comprises ten warp threads numbered 1 to 10, with respect to ten vertical columns, and 20 weft threads numbered 1 to 20 and an activation of the temple in the weaving area numbered 21, with respect to 21 rows in a development of the weave.

The warp threads numbered 1 to 3 correspond to the warp threads of the lower layer 11, and the warp threads numbered 2 to 4 correspond to the warp threads of the upper layer 10. The warp threads numbered 5 and 6 correspond to the binding threads, and the threads numbered 7 and 8 correspond to the warp threads of the handles 15. The warp thread numbered 9 corresponds to the binding thread of the edge 12, and the warp thread numbered 10 corresponds to the hook.

At the intersections of the rows and columns, the warp threads taken are shown in black in the conventional manner, and the warp threads left at the remaining intersections are shown in white.

Figure 6:
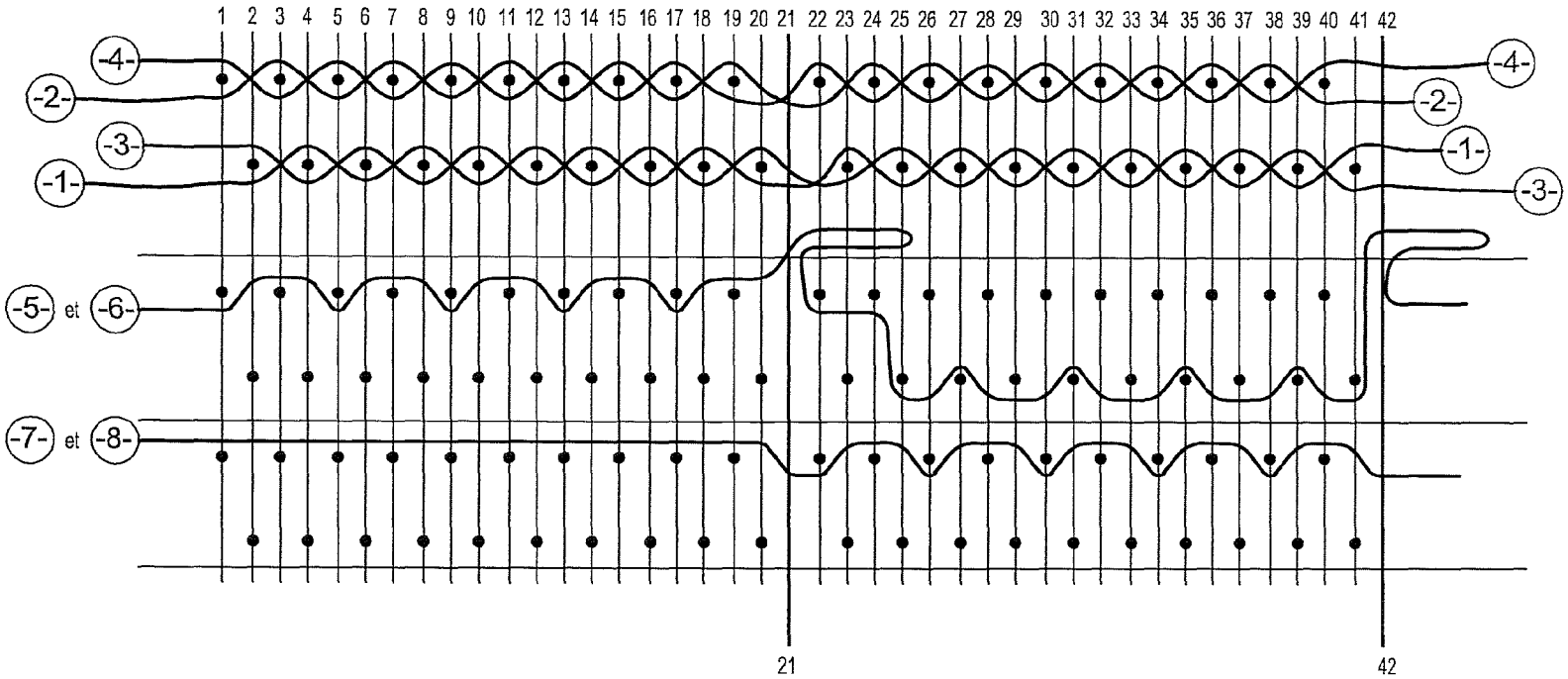
FIG. 6 schematically shows the weave from FIG. 5 reduced to weft threads and warp threads Nos. 1 to 8, the warp threads 5 and 6 being the binding threads.

Thus, for example, considering FIGS. 5 and 6, it is noted that the warp thread numbered 4 passes in succession (is taken) on the first two weft threads (Nos. 1 and 2), then passes under (is left) the weft thread No. 3, again passes over the three weft threads Nos. 4 to 6, then under the weft thread No. 7, then again over the three weft threads Nos. 8 to 10, then under the weft thread No. 11, then over the weft threads Nos. 12 to 14, then under the weft thread No. 15, then passes again over the three weft threads Nos. 16 to 18, then passes again over the weft thread No. 19, then under the weft thread No. 20, and starts again above the first two weft threads Nos. 22 and 23 in the subsequent development of the weave.

Moreover, it is noted that the row 21 of the weave corresponds schematically to the replacement of a filling pick, i.e., at one weaving phase, by insertion of the temple into the weaving area for drawing the binding threads numbered 5 and 6 and the removal of this temple from the weaving area. This corresponds to the absence of propulsion of the shuttle at the loom level.

The weaving of the upper layer 10 and the lower layer 11 with insertion of the binding threads into the weave of the lower layer 11 then resumes normally (row 22 and following rows).

Figure 7:
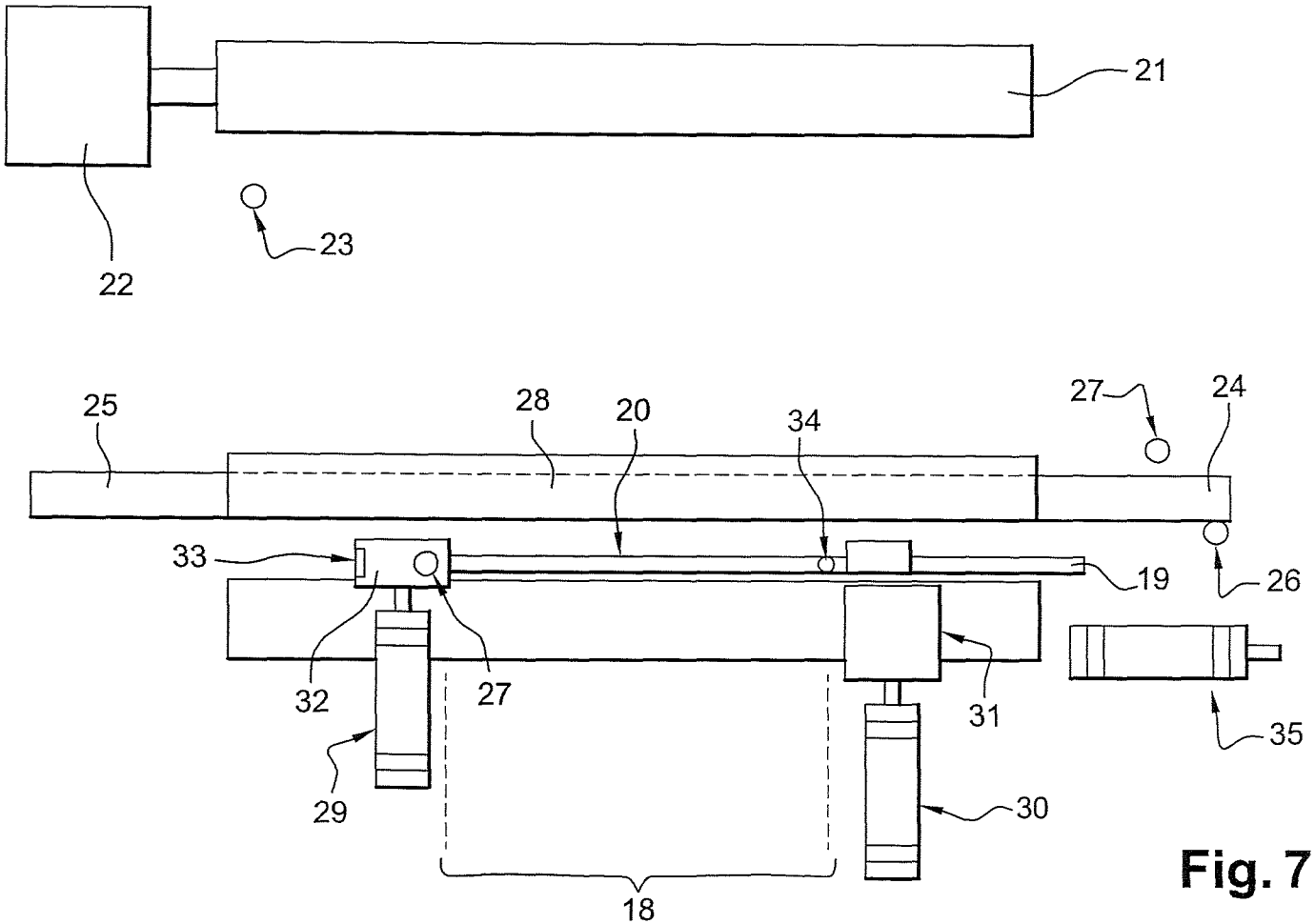
FIG. 7 is a partial view of the simplified loom, i.e., without stringers and without the shuttle in one embodiment of the invention.

FIG. 7 shows the loom for implementing the above-described method according to one embodiment. This loom comprises a weaving area 18 in which weft threads are inserted into at least one upper channel and one lower channel, each of these weft threads being inserted between at least two warp threads by at least one weft insertion element such as a shuttle or air jet or water jet. The loom likewise comprises first means for managing one of said channels and for determining the position of said warp threads relative to said weft thread. These first means can comprise, for example, a first harness by warp thread, these first harnesses being controlled by a weave mechanism that is likewise called a rat trap. The loom also comprises second means for inserting at least one binding thread above, between and below said channels. These second means comprise, for example, a second harness by binding thread, these second harnesses being controlled by the same weave mechanism.

The loom likewise comprises a temple 19 for drawing the binding threads and means of moving this temple outside of and into the weaving area 18 for placing this temple 19 in contact with the binding threads and for allowing them to be drawn.

Preferably, the edge 20 of this temple designed to receive the binding threads comprises means for holding these threads to maintain their spacing in a direction perpendicular to the direction of propagation of the weaving of the woven structure. On this edge, for example, the rod 19 has a rough surface or a network of vertical grooves (not shown) each intended to receive one or several binding threads.

The operation of the beam 21 carrying the binding threads is as follows. The operator powers a motor 22 that runs continuously until the operator decides to stop it or a first sensor 23 is activated, for example because the unwound length of the binding thread is too great. The motor 22 allows the binding threads to be unwound from the beam. Of course, this beam 21 must be replaced by a bobbin carrier when the form to be produced is complex, i.e., when the walls 10, 11 are not plane.

The loom on both sides of the weaving area 18 comprises the receiving elements such as boxes 24, 25 that allow temporary reception of the shuttle (not shown) so as to move the latter vertically to prevent its being thrown onto the loom, for example by a propulsive device of the cleat or air jet type.

The second sensor 26 makes it possible to detect that these boxes 24, 25 are placed vertically so that the shuttle cannot exit. It is then possible to draw the binding threads with the temple 19. The third sensor 27 makes it possible to detect conversely that the batten 28 is open for passage of the shuttle.

The means of moving the temple 19 first of all comprise two actuators 29, 30 of the jack or telescoping arm type that allow the temple to be advanced or retracted in the weaving area 18. These actuators 29, 30 are synchronized so that they work together. They are placed laterally to the weaving area 18, and their amplitude of movement allows determination of the length of the binding threads drawn by the temple 19.

These means of movement likewise comprise a third actuator 31 that allows lateral movement of the temple, i.e., causes the temple 19 to penetrate or leave the weaving area 18. When the temple 19 is placed in the weaving area 18, its end is received in a housing 32 provided for this purpose at the end of the first actuator 29. A fourth sensor such as a detector of a stop 33 makes it possible to detect that the end of the temple is in position in its housing 32 and stops the actuator 31. This actuator can be a roller placed on a drive shaft that converts rotary motion into translational motion.

A fifth sensor 34 makes it possible to detect for its part that the temple has completely left the weaving area 18.

The temple 19 can then move in translation along axes X and Y in the plane of the weaving area 18.

A fourth actuator 35 of the jack type makes it possible to engage and disengage the loom.

The cumulative initial conditions for allowing the starting of the operating cycle of the temple 19 are as follows:

one of the two boxes must be in the up position: second sensor 26 active, the loom must be in the open batten 28; third sensor 27 active, the temple 19 must be on the stop: fourth sensor 33 and fifth sensor 34 active, the first, second and fourth actuators are in the rest position, i.e., the rods of the jacks are, for example, retracted.

The method of the invention can be applied to the production of composite pieces in sheet metal manufacture as well as structural pieces used in building aircraft, for example fuselages or parts of the fuselage such as the wings of an aircraft or the radome. It is also possible to build jet tanks or reservoir skirts.

Maritime applications can also be envisioned, by way of illustration, the construction of ship hulls, container bodies, floats, . . . .

The invention claimed is:

1. A loom, comprising:

a weaving area (18) in which weft threads are inserted into at least one upper channel and one lower channel, each of said weft threads being inserted between at least two warp threads by at least one weft insertion element, first means for managing one of said channels and for determining the position of said warp threads relative to said weft thread, second means for inserting at least one binding thread (16) above, between and under said channels, at least one element for gripping said at least one binding thread (16) and means for moving said at least one gripping element outside of and into the weaving area (18) for placing said at least one gripping element (19) in contact with said at least one binding thread (16) and for allowing the drawing of said at least one binding thread (16).

2. The loom according to claim 1, wherein said at least one gripping element is a temple (19).

3. The loom according to claim 2, wherein an edge (20) of said temple that receives said at least one binding thread (16) comprises means to hold said binding threads to prevent said th reads (16) from slipping as the threads (16) are being drawn.

4. The loom according to claim 3, wherein at least the edge of said temple that receives said at least one binding thread (16) has a shape that imprints the relief to be imparted to one of said layers to the right of said at least one binding thread (16).

5. The loom according to claim 1, wherein said at least one gripping element is a needle comprising a hook at an end thereof.

6. The loom according to claim 5, further comprising individual means for control of each of said needles so as to allow variation of a length drawn from one binding thread (16) to another binding thread.

7. The loom according to claim 1, wherein the loom is a dry loom.

8. The loom according to claim 1, wherein the loom is an air jet loom.

9. The loom according to claim 1, wherein the loom is a spear loom.

10. The loom according to claim 1, wherein the loom is a projectile loom.

11. The loom according to claim 1, wherein the loom is operative for weaving at least first and second layers linked to one another by said at least one binding thread, by:

a) initiating weaving of said layers (10, 11) inserting at least one warp thread or supplementary filling pick, the filling pick comprising said binding thread (16), into the basic weave weave of said first layer;

b) suspending weaving of said layers (10, 11) before insertion of said at least one binding thread (16) into a basic weave of said second layer;

c) drawing said at least one binding thread (16) from a side of the second layer by placing at least a portion of a length drawn to an outside of an unit formed by the thus connected layers (10, 11); then d) resuming the weaving of said layers (10, 11) by inserting said at least one binding thread (16) into the basic weave of the second layer; and repeating the following cycle before each new insertion of said at least one binding thread (16) into the basic weave of one of these layers:

e) suspending the weaving of said layers (10, 11);

f) drawing said at least one binding thread (16) by placing at least one part of the length drawn to the outside of the unit formed by the thus connected layers (10, 11); and g) resuming weaving of the layers (10, 11) by inserting said at least one binding thread (16) into the basic weave of said layer, wherein a flexible inflatable reservoir is formed from the first and second layers.

* * * * *